US006131352A

United States Patent [19]

Barnes et al.

[11] Patent Number: 6,131,352

[45] **Date of Patent: *Oct. 17, 2000**

[54] FIRE BARRIER

[76] Inventors: Vaughn Barnes, 10882 Meaos Ave., Orange, Calif. 92663; Paul S. Heller, 14041 Mar Vista St., Whittier, Calif. 90602

[ * ] Notice: Under 35 U.S.C. 154(b), the term of this patent shall be extended for 690 days.

[21] Appl. No.: 08/766,105

[22] Filed: Dec. 16, 1996

Related U.S. Application Data

[63] Continuation of application No. 08/378,778, Jan. 26, 1995, abandoned.

[51] Int. Cl.[7] ..... E04B 1/68

[52] U.S. Cl. ..... 52/396.01; 52/396.04

[58] Field of Search ..... 52/317, 396.01, 52/396.02, 396.03, 396.04, 396.05, 396.06, 396.07, 396.08, 396.09, 396.1, 406.1, 406.2, 573.1; 404/66; 14/73.1, 73.5; 250/517.1, 519.1; 428/450, 920, 921

[56] References Cited

U.S. PATENT DOCUMENTS

| | | | |
|---|---|---|---|
| 2,099,589 | 11/1937 | Armbruster . | |
| 3,375,621 | 4/1968 | Curtis et al. | 52/573.1 |
| 3,786,604 | 1/1974 | Kramer . | |
| 3,948,295 | 4/1976 | Lemont et al. | 250/517.1 |
| 4,189,877 | 2/1980 | Jentoft et al. | 52/396.07 |
| 4,424,956 | 1/1984 | Grant et al. | 428/920 |
| 4,455,802 | 6/1984 | Charniga . | |
| 4,517,779 | 5/1985 | Dunsworth . | |
| 4,566,242 | 1/1986 | Dunsworth . | |
| 4,811,529 | 3/1989 | Harris et al. . | |
| 4,866,898 | 9/1989 | LaRoche et al. . | |
| 4,942,710 | 7/1990 | Rumsey . | |
| 4,967,527 | 11/1990 | Gohlke . | |
| 4,977,719 | 12/1990 | LaRoche et al. . | |
| 5,032,447 | 7/1991 | Bailey . | |
| 5,104,700 | 4/1992 | Peterson | 428/34.5 |
| 5,187,910 | 2/1993 | Nicholas et al. . | |
| 5,263,293 | 11/1993 | Gohlke et al. . | |
| 5,304,408 | 4/1994 | Jarosz et al. | 428/920 |

FOREIGN PATENT DOCUMENTS

| | | | |
|---|---|---|---|
| 626171 | 9/1978 | U.S.S.R. | 52/396.05 |
| 1434649 | 5/1976 | United Kingdom | 52/396.01 |

*Primary Examiner*—Michael Safavi
*Attorney, Agent, or Firm*—Fish & Associates, LLP; Robert D. Fish

[57] ABSTRACT

A fire barrier for use in dynamic voids to seal against the spread of fire. Flexible foil-backed insulation material is supported by a woven metallic support screen positioned in the void. As the surfaces defining the void undergo relative movement, the ability of the individual wire elements of the screen to move in a scissor-like fashion relative one another allow the screen to distort laterally without shearing, wrinkling, or buckling while the insulation material floating thereon is effectively isolated from any shear forces. The foil backing allows the insulation to freely shift relative the support screen.

14 Claims, 2 Drawing Sheets

FIRE BARRIER

This application is a continuation of application Ser. No. Ser. No. 08/378,778 filed Jan. 26, 1995 now abandoned.

BACKGROUND OF THE INVENTION

The present invention generally relates to fire barriers for use in dynamic voids formed in buildings, and more particularly, pertains to systems that are capable of maintaining an effective barrier against the spread of fire despite a substantial relative displacement or distortion of the surfaces that define such voids.

A variety of dynamic voids or joints are typically incorporated in a building in order to prevent damage as the structure undergoes movement due to thermal, wind and seismic loads. In order to prevent the spread of heat, smoke, and flames therethrough, it is necessary to fit such voids with fire barriers. It is especially important for a fire barrier fitted to a joint to remain in tact after the joint has undergone substantial displacement or distortion due to seismic activity, as the risk of fire is acute immediately following an earthquake.

Various barrier systems have been devised that attempt to accommodate the magnitude of movement anticipated during a seismic event. A substantial widening and/or narrowing, as well as substantial lateral or shear displacement of a seismic joint can be expected. Fire barriers typically consist of a sheet of flexible material that is attached to each wall of the joint and loosely draped therebetween. Such configuration does not in any way impede the narrowing of the gap while the slack in the material accommodates a widening of the gap beyond its nominal width. Its inherent flexibility also allows the material to take up any differential vertical displacement between the two sides of the joint. Despite being flexible, the previously used barrier materials are, however, substantially less capable of accommodating relative lateral displacement between the sides of the joint, and are prone to shear failure. In an effort to address this shortcoming, various complex mechanisms have additionally been developed in order to allow one or both sides of the barrier to shift along the walls of the joint. Some configurations provide for the barrier to be rigidly affixed to one side of the joint while the opposite edge of the barrier is slideably retained in a groove or track attached to the opposite wall of the joint. Alternatively, both edges of the barrier are retained within grooves or tracks formed in both sides of the joint in order to allow both sides to shift laterally relative the walls of the joint.

These prior art fire barrier systems suffer from a number of disadvantages. The complexity of many of such systems renders their initial cost rather high. Moreover, installation of a complex system is often more difficult, especially for retrofitment to existing buildings thereby further increasing the overall cost. Finally, the various mechanisms that allow such systems to accommodate lateral displacement typically rely on various moving parts that would require periodic maintenance. The prior art is therefore substantially devoid of a simple, low cost, low maintenance barrier system that is easily installed and that is capable of accommodating relative lateral displacement.

SUMMARY OF THE INVENTION

The present invention provides a fire barrier system that prevents the spread of smoke, heat and flame through a dynamic void such as a seismic joint. The system's configuration ensures that an effective barrier is maintained despite substantial relative displacement or distortion of the joint in all three dimensions. Moreover, the barrier is relatively inexpensive, is easily installed, is readily retrofitted to many existing joint configurations and requires essentially no maintenance.

The fire barrier system of the present invention consists of foil-backed insulative material supported in a free-floating manner by a woven metallic screen component that is draped between the two sides of the dynamic void. A loosely woven structure is critical in enabling the support component to accommodate relative lateral displacement of opposite edges without wrinkling or buckling. The ability of the individual wire elements to shift relative one another with a scissor-like motion serves to relieve shear stresses, and thereby provides for a uniform dimensional adjustment to lateral distortion. Because the insulation is supported in a free-floating manner by the support screen, the insulation essentially remains stationary and undistorted as the screen shifts and distorts to accommodate lateral displacement of the joint walls. The presence of the foil between the insulation and support screen reduces friction between the insulation and the support screen to insure free relative movement therebetween. The insulation material is thereby effectively isolated from shear forces that would otherwise be transferred thereto.

A single support screen component may be employed to support the insulation layer from below. Alternatively, the insulation layer may be sandwiched between two woven metallic support screens so as to freely float therebetween. The system of the present invention is easily adaptable to horizontal and vertical applications, as well as transitions between horizontal and vertical surfaces.

The barrier system of the present invention satisfies a need for a simple, easily installed, and relatively inexpensive device capable of preventing the spread of smoke, flame, and heat through a dynamic joint despite substantial distortion of such joint in all three dimensions. These and other features and advantages of the present invention will become apparent from the following detailed description of preferred embodiments which, taken in conjunction with the accompanying drawings, illustrate by way of example the principles of the invention.

DETAILED DESCRIPTION OF PREFERRED EMBODIMENTS

The figures illustrate the fire barrier system of the present invention. The system generally consists of a flame, heat, and smoke proof barrier material that is supported between opposite sides of a dynamic void. The system allows the sides of the void to undergo relative movement in all three dimensions without compromising the barrier's ability to perform its sealing function.

Figure 1:
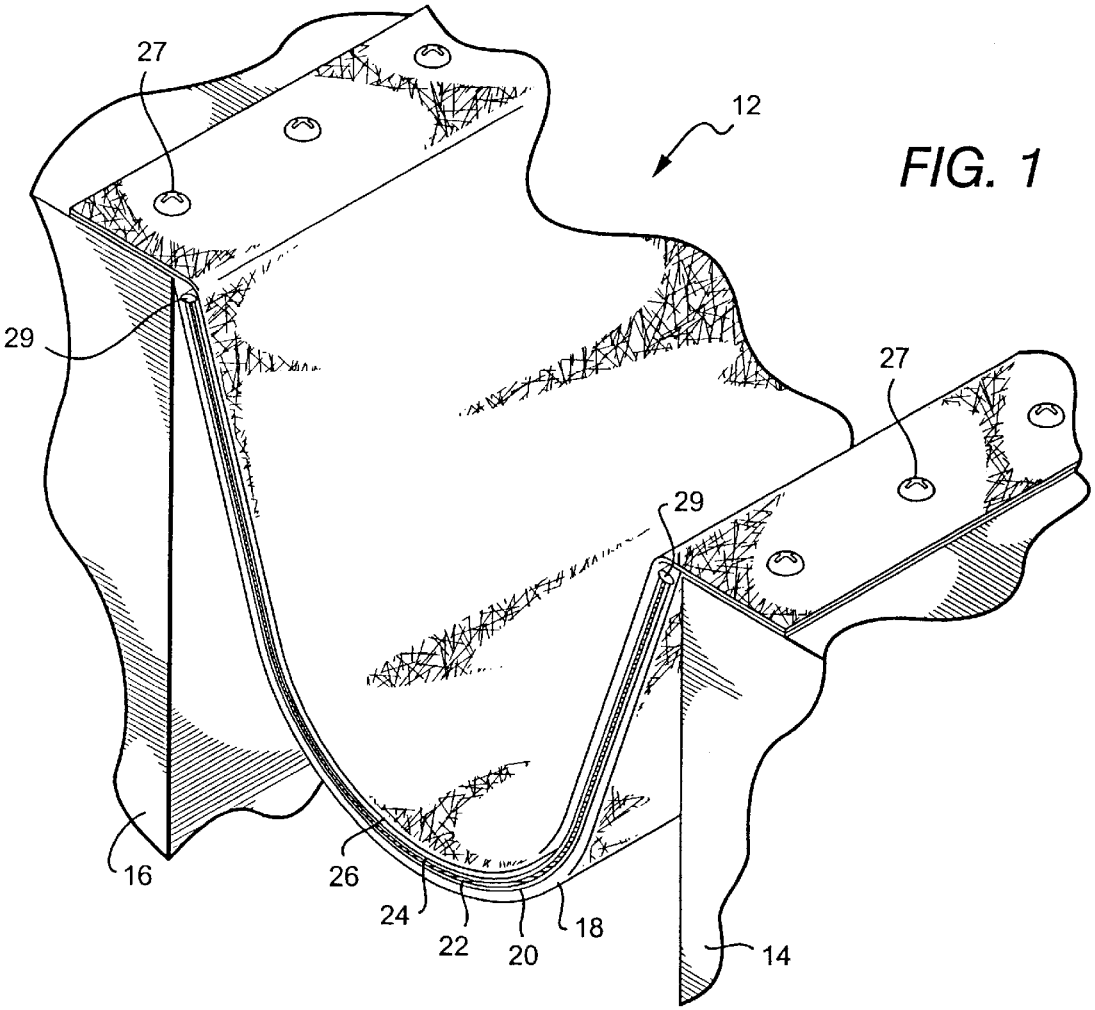
FIG. 1 is a cross-sectioned perspective view of the fire barrier system of the present invention.

FIG. 1 illustrates an embodiment of the invention wherein the barrier system 12 is disposed between the two sides 14, 16 of a dynamic void extending across a horizontal surface. A support screen 18 and a retention screen 26 are disposed in parallel to one another, and are draped between the two sides of the void. The edges of the screens are rigidly affixed to the sides of the void by any appropriate fastening system. Shown as an example only are screws or bolts 27 that extend through both screens into the edges of the joint therebelow. Alternatively, a rigid flange extending along the entire length of each edge of the screen may be relied upon to sandwich the two screen edges against the edges of the joint.

Supported between the two screen components 18, 26 in a free floating manner is barrier material consisting of metallic foil 20, 24 backing positioned on either side of refractory matting 22. The layers may simply lie on top of one another or may be adhesively bonded to one another, or preferably, the structure may simply be held together by staples. The width of the foil backed material 22 is narrower than the width of the support screen 18, 26 such that its edges remain clear of the area where the screens converge and are fastened to the side of the joint. Intumescent fire caulking 29 is positioned along the edge of the refractory material. The horizontal configuration illustrated in FIG. 1 is easily adapted to vertical configurations, as well as horizontal to vertical surface transitions.

It is critical for the support and the retention screen to have a sufficiently loosely woven structure so as to allow the individual wire elements of the weave to shift relative one another in a scissor-like fashion. The screen preferably consists of stainless steel wires, about 0.0075" in diameter at 24 wires per inch. The use of stainless steel wire mesh with a wire diameter of 0.008" at approximately eight wires per inch has also been found to be advantageous due the material's exceptional flexibility. The refractory material preferably consists of ¼" thick 12# ceramic fiber insulation blanket backed by 0.003" stainless steel foil on the hot side, and 0.003" aluminum foil on the opposite side.

Figure 2:
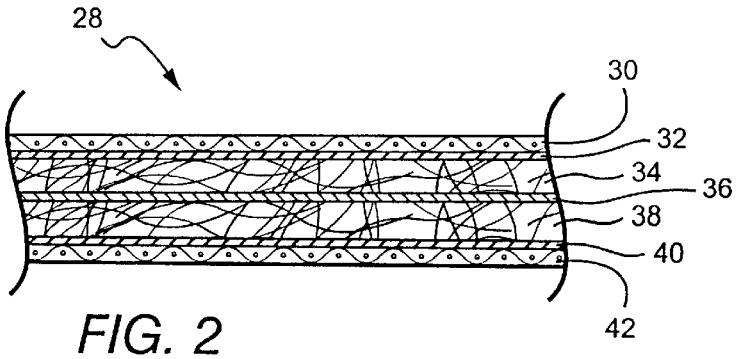
FIG. 2 is an enlarged cross-section of a portion of an alternative embodiment barrier material.

FIG. 2 shows an alternative embodiment wherein the barrier material includes an additional layer of insulation. The barrier material freely floats between woven stainless steel support and retention screens 30, 42, and consists of stainless steel foil backing 40 on the hot side, aluminum foil backing 32 on the opposite side, two layers of refractory matting 34, 38, and an additional septum layer of stainless steel foil 36 therebetween. Elements 32, 34, 36, 38, and 40 may simply lie on top of one another, may be adhesively bonded to one another, or are preferably stapled together.

Figure 3:
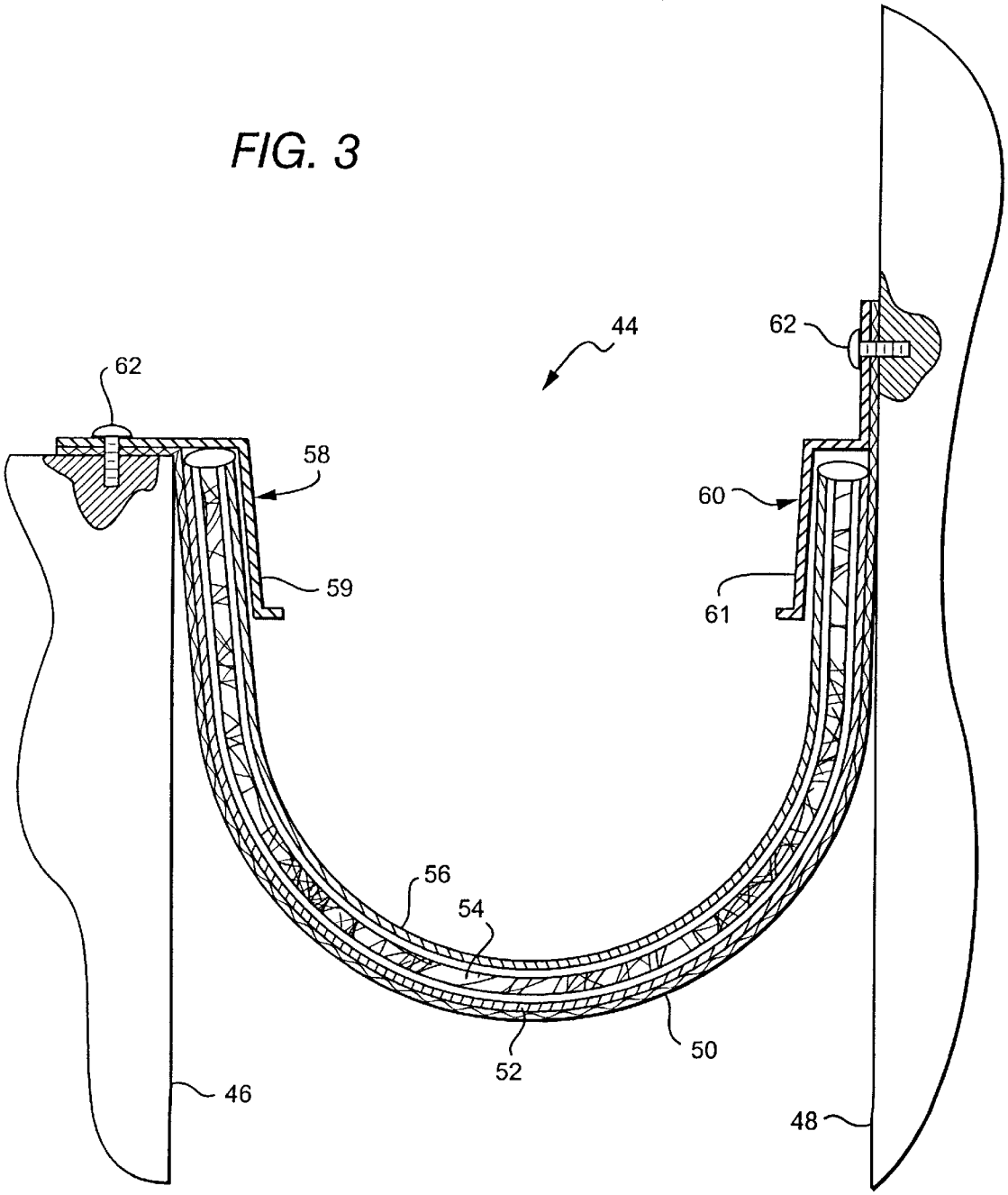
FIG. 3 is a cross-section of an alternative embodiment of the fire barrier system of the present invention.

FIG. 3 illustrates an alternative embodiment of the barrier system wherein the retention screen 26 of the embodiment illustrated in FIG. 1 is replaced by retention flanges 58 and 60. The barrier material, consisting of foil backing 52, 56 on either side of refractory matting 54, is supported in a free-floating manner by support screen 50. The support screen has a loosely woven structure that allows its individual wire elements to shift relative one another such that lateral distortion does not result in shearing, buckling, or wrinkling. A rigid retention flange 58 is attached to the side 46 of the joint to positively hold screen 50 in position, while its projecting lip 59 loosely retains the barrier material in position over the screen and across the joint. FIG. 3 illustrates an adaptation of the device to a transition between a horizontal and vertical surface whereby an appropriately modified flange 62 is attached to the vertical wall. The flange again performs the dual function of affixing the edge of the screen 50 to the joint wall 48, while its projecting lip 61 controls the position of the barrier material. The single support screen configuration can, of course, also be adapted to a horizontal application wherein two L-shaped retention flanges 58 are used, as well as wholly vertical applications wherein two Z-shaped retention flanges 60 are employed.

The barrier system of the present invention not only accommodates relative movement of the sides toward and away from one another, as well as relative up and down movement, but allows for relative lateral displacement. The scissor-like freedom of movement of the individual wires forming the woven support screen allow opposite edges of the screen to be shifted laterally relative one another without causing the screen to buckle or wrinkle, such that the foil-backed insulative material floating thereon is effectively isolated from any shear forces. The insulation is thereby able to continue to fulfill its insulative function during and after three dimensional relative displacement of the surfaces that define the joint.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A fire barrier system for sealing a dynamic void between architectural structures, comprising:

a metallic support screen spanning said void, a portion of said screen affixed to at least one of the architectural structures; and insulation material non-rigidly coupled to and supported by said support screen in a free-floating manner such that said insulation material is substantially isolated from sheer forces resulting from relative movement between the structures.

2. The fire barrier system of claim 1 wherein a layer of metallic foil is positioned between said support screen, and said insulation to reduce friction therebetween.

3. The fire barrier system of claim 2 wherein said foil is bonded to said insulation material.

4. The fire barrier system of claim 2 wherein said foil is stapled to said insulation material.

5. The fire barrier system of claim 2 wherein a layer of metallic foil is positioned on both sides of said insulation material.

6. The fire barrier system of claim 5 wherein said foil layers are bonded to said insulation material.

7. The fire barrier system of claim 5 wherein said foil layers and said insulation material are stapled together.

8. The fire barrier system of claim 1 wherein opposite edges of said support screen are rigidly attached to opposite sides of said dynamic void, and wherein said screen is wider than said dynamic void.

9. The fire barrier system of claim 1 wherein a rigid retention flange projects from each side of the void over a portion of said insulation material to maintain the insulation material in position over said support screen.

10. The fire barrier system of claim 2 wherein a metallic retention screen spans said void in parallel with said support screen so as to sandwich said insulation material in between it and said support screen in a free-floating manner.

11. A fire barrier system for sealing a dynamic void, comprising:

a loosely woven stainless steel screen spanning said void and rigidly affixed to the edges of said void;

a layer of stainless steel foil positioned over said screen in a free floating manner, said foil being narrower than said screen, the foil non-rigidly coupled to the screen; and refractory matting of substantially the same width as said foil positioned over said foil.

12. The fire barrier system of claim 11 further comprising a layer of metallic foil positioned over said matting.

13. The fire barrier system of claim 12 further comprising a loosely woven stainless steel screen spanning said void, positioned over said metallic foil in a free floating manner, and rigidly affixed to the edges of said void.

14. The fire barrier system of claim 12 further comprising rigid retention flanges extending from the edges of said void to maintain said free-floating foil layers, and said refractory matting in position over said screen.

* * * * *